US012421963B2

(12) United States Patent
Ozasa et al.

(10) Patent No.: US 12,421,963 B2
(45) Date of Patent: Sep. 23, 2025

(54) REFRIGERANT CIRCULATION DEVICE AND PUMP UNIT

(71) Applicant: Nidec Corporation, Kyoto (JP)

(72) Inventors: Kota Ozasa, Kyoto (JP); Makoto Itsuki, Bietigheim-Bissingen (DE)

(73) Assignee: NIDEC CORPORATION, Kyoto (JP)

( * ) Notice: Subject to any disclaimer, the term of this patent is extended or adjusted under 35 U.S.C. 154(b) by 38 days.

(21) Appl. No.: 18/581,497

(22) Filed: Feb. 20, 2024

(65) Prior Publication Data

US 2024/0287984 A1 Aug. 29, 2024

(30) Foreign Application Priority Data

Feb. 27, 2023 (JP) ..... 2023-028430

(51) Int. Cl.
*F04B 53/22* (2006.01)
*F04B 49/06* (2006.01)
*F04B 23/04* (2006.01)

(52) U.S. Cl.
CPC ..... *F04B 53/22* (2013.01); *F04B 49/065* (2013.01); *F04B 23/04* (2013.01)

(58) Field of Classification Search
CPC ..... F04B 17/03; F04B 35/04; F04B 49/06; F04B 53/22; F04B 49/065; F04B 23/04; F04C 14/00; F04C 28/00; F04C 2270/00; F04D 15/00; F04D 27/00
See application file for complete search history.

(56) References Cited

U.S. PATENT DOCUMENTS 9,834,452 B1 * 12/2017 Fuller ..... B67D 7/74
2023/0193894 A1 * 6/2023 Lee ..... F04B 49/007 417/279

* cited by examiner

*Primary Examiner* — Shafiq Mian
(74) *Attorney, Agent, or Firm* — Keating & Bennett, LLP

(57) ABSTRACT

A refrigerant circulation device includes a chassis, a pump assembly, mounting portions, and a controller. The chassis includes a flow path of refrigerant. The mounting portions are provided at different positions in the chassis. The pump assembly is detachably mounted to each of the mounting portions. The controller is configured or programmed to execute specification processing to specify a mounted state of the pump assembly to any one of the mounting portions multiple times at time intervals, and control the pump assembly mounted to the mounting portions based on the mounted state specified in the specification processing. The pump assembly pressure-feeds the refrigerant to the flow path under the control of the controller.

8 Claims, 7 Drawing Sheets

REFRIGERANT CIRCULATION DEVICE AND PUMP UNIT

CROSS-REFERENCE TO RELATED APPLICATIONS

The present application claims priority under 35 U.S.C. § 119 to Japanese Patent Application No. 2023-028430, filed on Feb. 27, 2023, the entire contents of which are hereby incorporated herein by reference.

1. FIELD OF THE INVENTION

The present disclosure relates to refrigerant circulation devices and pump assemblies.

2. BACKGROUND

In the refrigerant circulation device of the related art, a plurality of mounting portions are provided at different positions of a chassis. One pump assembly can be detachably mounted to each of the mounting portions.

When the refrigerant circulation device is provided with a plurality of mounting portions, it is necessary to accurately recognize which mounting portion the pump assembly is mounted to.

SUMMARY

A refrigerant circulation device according to an example embodiment of the present disclosure includes a chassis, at least one pump assembly, a plurality of mounting portions, and a controller. The chassis includes a flow path of refrigerant. The plurality of mounting portions are provided at different positions in the chassis. The pump assembly is detachably mounted to each of the plurality of mounting portions. The controller is configured or programmed to execute specification processing to specify a mounted state of the pump assembly to any one of the plurality of mounting portions a plurality of times at time intervals, and control of the pump assembly mounted to the plurality of mounting portions based on the mounted state specified in the specification processing. The pump assembly pressure-feeds the refrigerant to the flow path under the control of the controller.

A pump assembly according to another example embodiment of the present disclosure is detachably mounted to mounting portions provided at different positions in a chassis including a flow path of refrigerant. The pump assembly includes a controller. The controller is configured or programmed to execute specification processing of specifying a mounted state of the pump assembly to the mounting portion a plurality of times at time intervals, and control of the pump assembly mounted on the plurality of mounting portions based on each of the mounted states specified in the specification processing.

The above and other elements, features, steps, characteristics and advantages of the present disclosure will become more apparent from the following detailed description of the example embodiments with reference to the attached drawings.

DETAILED DESCRIPTION

Figure 1:
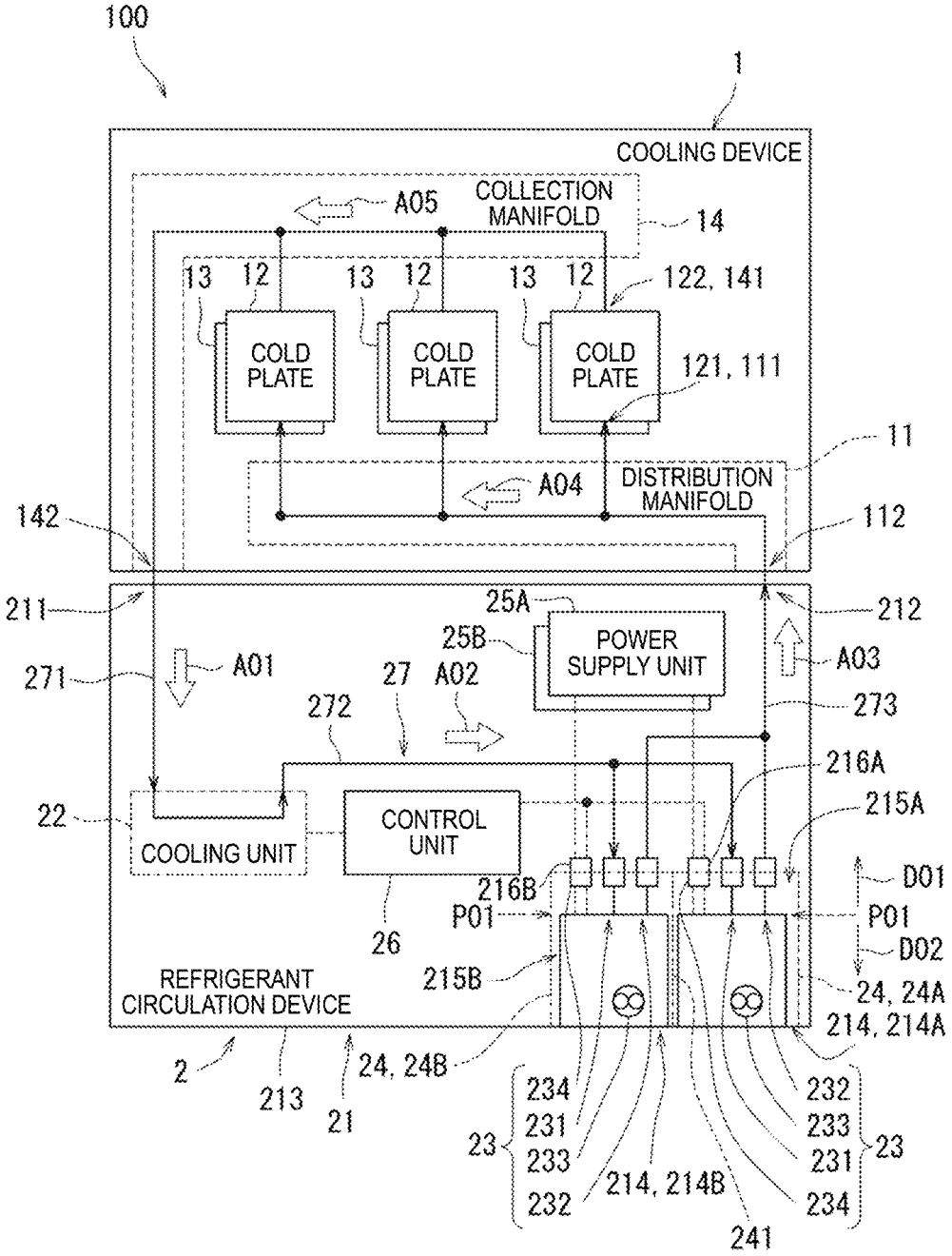
FIG. 1 is a block diagram illustrating a configuration of a cooling system according to an example embodiment of the present disclosure.

Hereinafter, cooling systems according to example embodiments of the present disclosure will be described with reference to the drawings. In the drawings, the same or corresponding parts are denoted by the same reference numeral and description thereof will not be repeated.

FIG. 1 is a block diagram illustrating a configuration of a cooling system 100. As illustrated in FIG. 1, the cooling system 100 includes a cooling device 1 and a refrigerant circulation device 2.

The cooling device 1 includes a distribution manifold 11, a plurality of cold plates 12, a plurality of heat sources 13, and a collection manifold 14. The cooling device 1 may not include the distribution manifold 11 and the collection manifold 14. In addition, the number of each of the cold plates 12 and the heat sources 13 may be at least one.

In the cooling system 100, the refrigerant circulates among the refrigerant circulation device 2, the distribution manifold 11, the plurality of cold plates 12, and the collection manifold 14 as indicated by a plurality of arrows A01 to A05. The refrigerant is, for example, a coolant. Examples of the coolant include antifreeze liquid and pure water. A typical example of antifreeze liquid is an ethylene glycol aqueous solution or a propylene glycol aqueous solution.

High-temperature refrigerant flows into the refrigerant circulation device 2 from the collection manifold 14 (see arrow A01). The refrigerant circulation device 2 cools and pressure-feeds the refrigerant. When the refrigerant is pressure-fed, the refrigerant circulates in the cooling system 100 (see arrows A01 to A05). Specifically, the low-temperature refrigerant flows into the plurality of cold plates 12 via the distribution manifold 11 (see arrow A04) and flows through the plurality of cold plates 12. The plurality of cold plates 12 are in thermal contact with the plurality of heat sources 13. Each heat source 13 is typically a device that generates heat, and is a component of a computer device in the example embodiment. The computer device is typically a blade server. Other examples of the heat source 13 include an electrolytic capacitor, a power semiconductor module, and a printed circuit board.

Each of the cold plates 12 has an inflow port 121 and an outflow port 122. In FIG. 1, for convenience, reference numerals "121" and "122" are representatively given to only one cold plate 12. The refrigerant flows into each of the inflow ports 121 from the downstream end 111 of the distribution manifold 11 (see arrow A04). The refrigerant flows from the inflow port 121 toward the outflow port 122 at each cold plate 12. Accordingly, the heat generated by the heat source 13 moves to the refrigerant flowing in each cold plate 12. As a result, the temperature of the refrigerant becomes high. The high-temperature refrigerant flows out from each outflow port 122 to each upstream end 141 of the collection manifold 14 and flows in the collection manifold 14 (see arrow A05).

The refrigerant circulation device 2 includes a chassis 21, a cooling unit 22, a first number of pump assemblies 23, a second number of mounting portions 24, power supply units 25A and 25B, a controller 26, and a flow path 27. The first number is at least one, and the second number is a plurality. In the example embodiment, each of the first number and the second number is two. The two pump assemblies 23 have the same specification. The same reference numeral "23" is attached to each pump assembly for convenience. The two mounting portions 24 are two mounting portions 24A and 24B having different specifications.

The chassis 21 has an inflow port 211 for refrigerant and an outflow port 212 for refrigerant (see FIG. 1). The inflow port 211 is connected with a downstream end 142 of the collection manifold 14. The refrigerant flows into the inflow port 211 from the downstream end 142. The outflow port 212 is connected with an upstream end 112 of the distribution manifold 11. The refrigerant flows out from the outflow port 212 to the upstream end 112.

The chassis 21 accommodates the cooling unit 22, the pump assemblies 23, the power supply units 25A and 25B, the controller 26, and the flow path 27. That is, the chassis 21 has the refrigerant flow path 27. Among the cooling unit 22, the pump assembly 23, the power supply units 25A and 25B, the controller 26, and the flow path 27, only the pump assembly 23 is easily detachable from the chassis 21, and the components other than the pump assembly 23 are fixed to the chassis 21.

The cooling unit 22 cools the refrigerant flowing through the flow path 27. The type of the cooling unit 22 is not particularly limited. That is, as the cooling unit 22, an air cooling system or a water cooling system can be adopted. In the case of the air cooling system, the cooling unit 22 includes a radiator and a fan. The radiator is connected to the downstream end of a pipe 271. High-temperature refrigerant flows into the radiator from the downstream end of the pipe 271. The radiator is connected to the upstream end of a pipe 272. The radiator guides the refrigerant flowing in from its own inflow port to its own outflow port. In the process, the refrigerant flowing in the radiator is cooled by the airflow generated by the fan. As a result, low-temperature refrigerant flows out from the outflow port of the radiator.

Each pump assembly 23 can pressure-feed the refrigerant in the flow path 27 in a state of being mounted to any one of the mounting portions 24A and 24B described later. Specifically, each pump assembly 23 includes a suction port 231, a discharge port 232, a pump rotor 233, and a connector 234. When each pump assembly 23 is mounted, the suction port 231 is connected to the downstream end of the pipe 272. At the time of attachment, the discharge port 232 is connected to the upstream end of a pipe 273. In each pump assembly 23, pressure is applied to the refrigerant by the rotation of the pump rotor 233. As a result, the refrigerant in the pipe 272 is sucked from the suction port 231. The sucked refrigerant is discharged from the discharge port 232 to the pipe 273. Further, the connector 234 is an example of a "first connector" in the present disclosure. Details of the connector 234 will be described later.

The type of each pump assembly 23 is not particularly limited. That is, as the pump assembly 23, for example, a centrifugal pump, a propeller pump, a viscous pump, or a rotary pump can be adopted. The pump rotor 233 is an impeller when the pump assembly 23 is a centrifugal pump, a propeller pump, a viscous pump, or a gear pump. The pump rotor 233 is a screw when the pump assembly 23 is a screw pump.

A second number of openings 214 are formed at different positions on an outer wall 213 of the chassis 21. Therefore, in the example embodiment, two openings 214A and 214B are formed in the outer wall 213. The openings 214A and 214B are adjacent to each other. Accommodation spaces 215A and 215B extend from the openings 214A and 214B toward the inside of the chassis 21. Specifically, the accommodation spaces 215A and 215B extend in a proximity direction D01 (described later) from the openings 214A and 214B, respectively. Each of the accommodation spaces 215A and 215B has a shape capable of accommodating each of the pump assemblies 23.

The mounting portions 24A and 24B partition the accommodation spaces 215A and 215B, respectively. Therefore, the plurality of mounting portions 24A and 24B are provided at different positions in the chassis 21. One of the pump assemblies 23 is detachably mounted to each of the mounting portions 24A and 24B. Specifically, the mounting portions 24A and 24B have a partition 241. The mounting portions 24A and 24B may include a part of the outer wall 213. In the example embodiment, the mounting portion 24B includes a part of the outer wall 213. In the following description, unless otherwise specified, the term "pump assembly 23" means the pump assembly 23 in the mounted state.

The power supply units 25A and 25B are power supply circuits or the like. The power supply unit 25A generates a DC voltage Vcc from an AC voltage supplied from a commercial power source, for example. On the other hand, the power supply unit 25B generates a DC voltage Vdd1 lower than the DC voltage Vcc from the AC voltage. In the example embodiment, the DC voltages Vcc and Vdd1 are 54 V and 3.3 V, respectively. The DC voltage Vcc is supplied to the cooling unit 22 and each pump assembly 23. The DC voltage Vdd1 is supplied to the controller 26 and each pump assembly 23.

The controller 26 includes a microcomputer and a memory that are not shown, and operates with the DC voltage Vdd1. The microcomputer controls at least the operation of each pump assembly 23 in accordance with a program stored in the memory.

The flow path 27 includes the pipes 271 to 273. By the pipes 271 to 273, the cooling unit 22 and each pump assembly 23 are connected between the inflow port 211 and the outflow port 212 so that the refrigerant flows. Specifically, the upstream end of the pipe 271 is connected to the inflow port 211 of the chassis 21. The downstream end of the pipe 271 is connected to the inflow port of the cooling unit 22. The upstream end of the pipe 272 is connected to the outflow port of the cooling unit 22. At the downstream end of the pipe 272, the suction port 231 (see FIG. 3) of each pump assembly 23 is detachably located at the mounting portions 24A and 24B. The upstream end of the pipe 273 is located in each mounting portion 24 such that the discharge port 232 (see FIG. 3) of each pump assembly 23 is detachably mounted. The downstream end of the pipe 273 is connected to the outflow port 212 of the chassis 21. As a result, in the chassis 21 (that is, the refrigerant circulation device 2), the refrigerant can flow from the inflow port 211 to the outflow port 212 via the cooling unit 22 and the respective pump assemblies 23 (see arrows A01 to A03).

Figure 2:
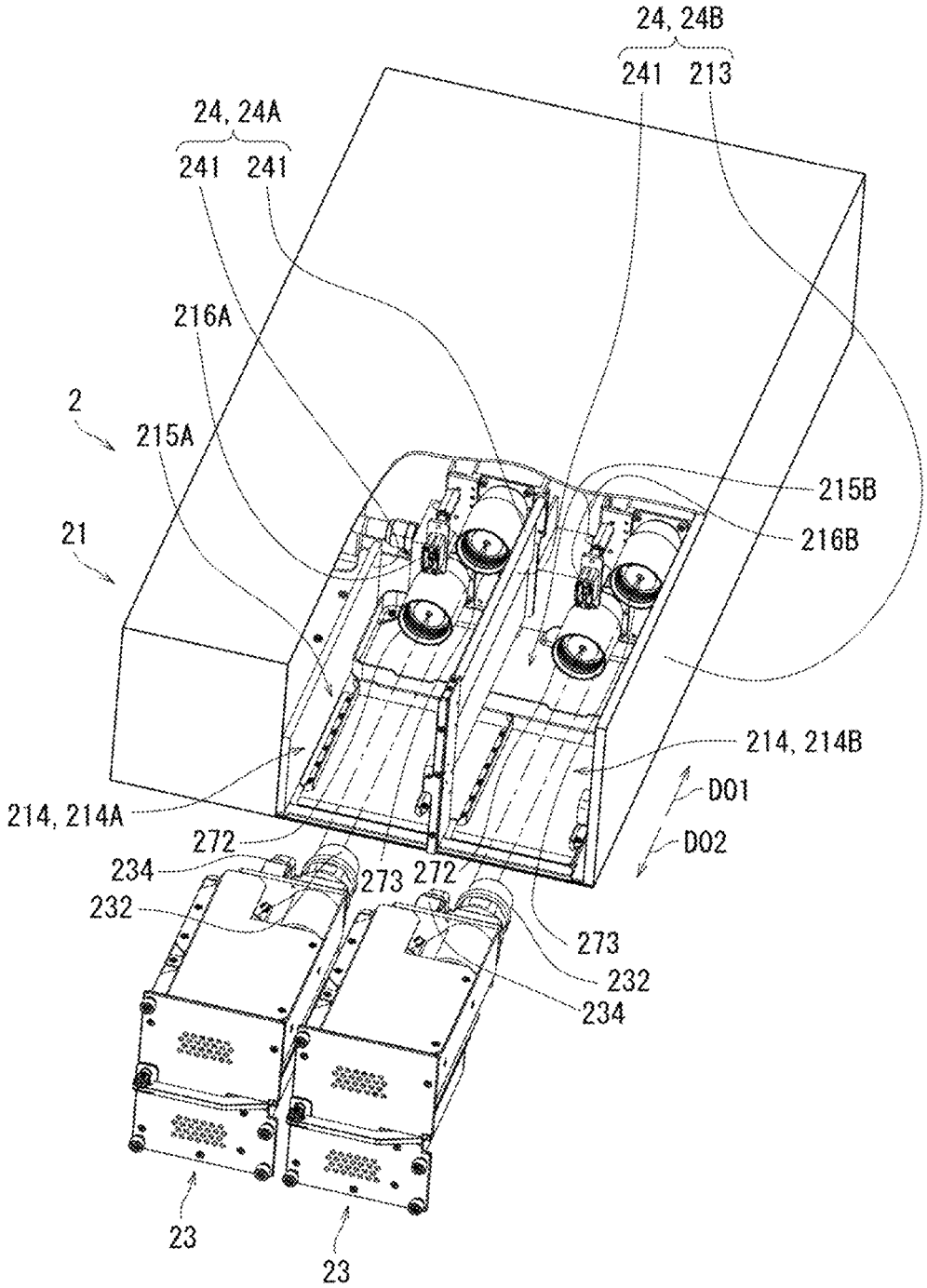
FIG. 2 is a perspective view illustrating a main portion of a refrigerant circulation device according to an example embodiment of the present disclosure.
Figure 3:
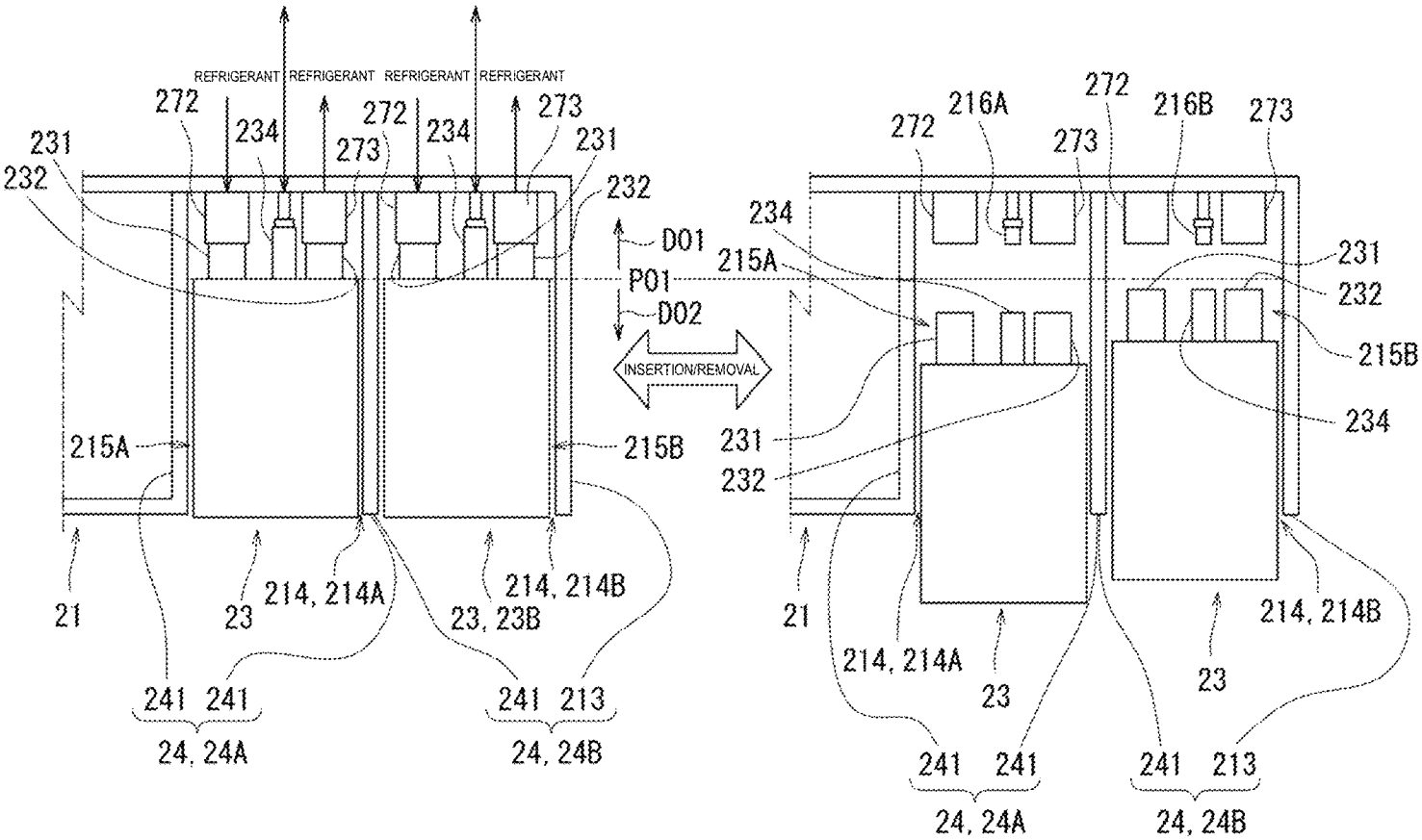
FIG. 3 is a schematic diagram illustrating insertion and removal of each pump assembly into and from a mounting portion in detail.

FIG. 2 is a perspective view illustrating a main portion of the refrigerant circulation device 2. FIG. 3 is a schematic diagram illustrating details of insertion and removal of each pump assembly 23 with respect to the mounting portions 24A and 24B.

As illustrated in FIGS. 1 to 3, each pump assembly 23 is movable in both the proximity direction D01 and the separation direction D02 inside each of the accommodation spaces 215A and 215B through each of the openings 214A and 214B by a force applied from a person. The proximity direction D01 is a direction from the openings 214A and 214B toward a mounting position P01 defined in advance in the accommodation spaces 215A and 215B. The separation direction D02 is a direction opposite to the proximity direction D01 and is a direction from the mounting position P01 toward the openings 214A and 214B. A state where each pump assembly 23 is correctly positioned at the mounting position P01 corresponds to the mounted state mentioned above.

The downstream end of the pipe 272, the upstream end of the pipe 273, and connectors 216A and 216B are located at the back of the mounting portions 24A and 24B. The connectors 216A and 216B are an example of a "second connector" in the present disclosure. The back of the mounting portions 24A and 24B is a portion separated from the openings 214A and 214B in the proximity direction D01 in the accommodation spaces 215A and 215B. Details of the connectors 216A and 216B will be described later.

The suction port 231 of the pump assembly 23 is connected to the downstream end of the pipe 272, and the discharge port 232 of the pump assembly 23 is connected to the upstream end of the pipe 273 (see FIG. 3). Each pump assembly 23 is further fixed to the chassis 21 with a fixing tool such as a screw (see FIG. 2). As a result, the refrigerant can flow from the pipe 272 to the suction port 231, and the refrigerant can flow from the discharge port 232 to the pipe 273. The connector 234 is electrically connected to any one of the connectors 216A and 216B in the mounted state. That is, the chassis 21 includes the connectors 216A and 216B to and from which the connectors 234 can be mounted and detached in each of the plurality of mounting portions 24. While the pump assembly 23 moves from the mounting position P01 in the separation direction D02, the connector 234 is removed from the connector 216. Note that the details of the connector 234 will be described later.

Figure 4:
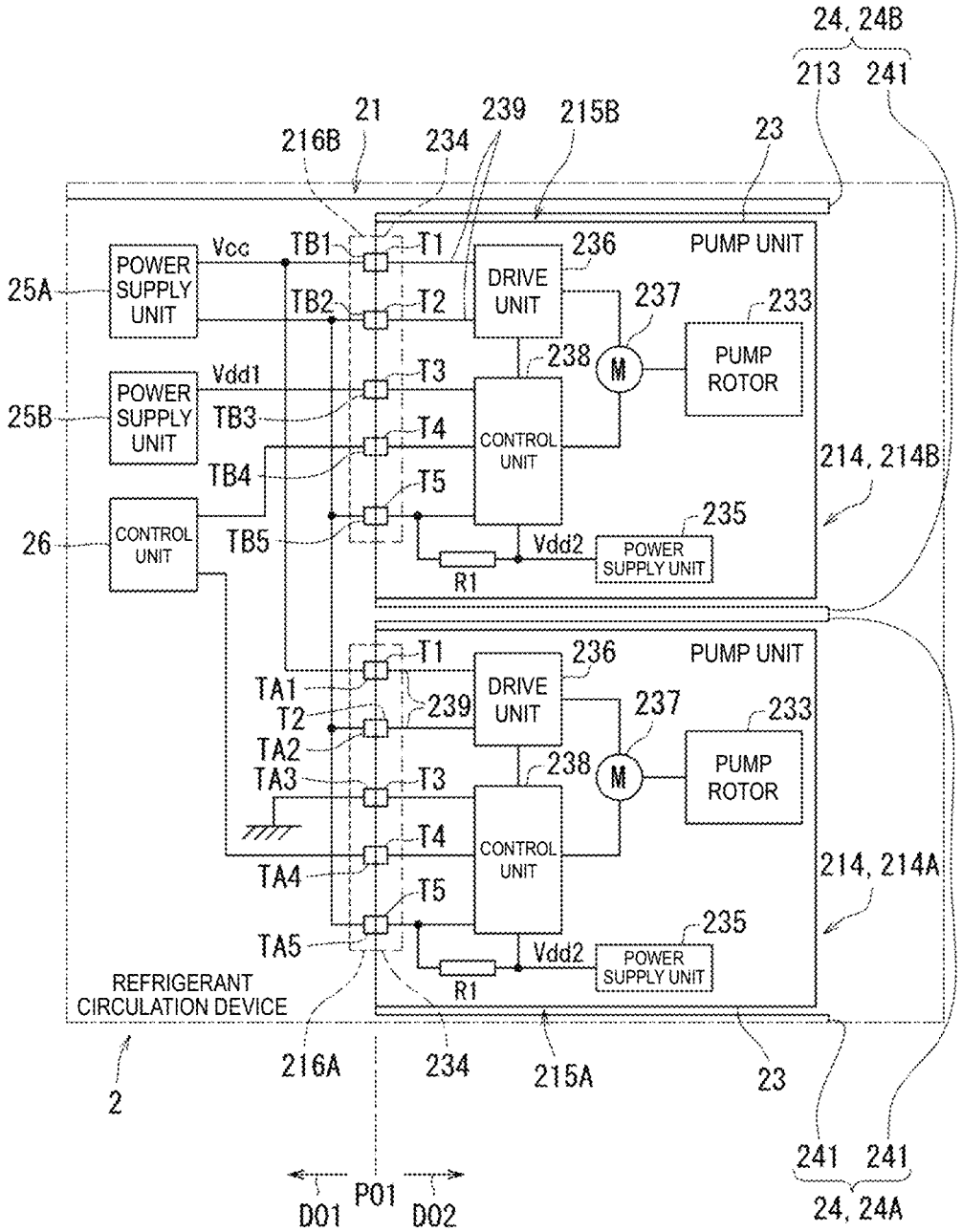
FIG. 4 is a block diagram illustrating a detailed configuration of a pump assembly according to an example embodiment of the present disclosure.

FIG. 4 is a block diagram illustrating a detailed configuration of the pump assembly 23 illustrated in FIGS. 1 to 3. FIG. 4 illustrates the connectors 216A and 216B, the power supply units 25A and 25B, and the controller 26 in addition to the detailed configuration of each pump assembly 23. The controller 26 is an example of a "controller" or a "first controller" in the present disclosure.

As illustrated in FIG. 4, the connector 216A includes at least terminals TA1 to TA5. The connector 216B has at least terminals TB1 to TB5. The DC voltage Vcc generated by the power supply unit 25A is applied between the terminals TA1 and TA2 and between the terminals TB1 and TB2. Each of the terminals TA2 and TB2 is electrically connected to the ground terminal of the power supply unit 25A. The terminal TA3 is grounded. Therefore, it is equivalent to that a position signal of 0 V, that is, a low-level position signal is output from the terminal TA3. The DC voltage Vdd1 generated by the power supply unit 25B is applied to the terminal TB3 as a position signal (described later). Each of the terminals TA4 and TB4 is electrically connected to a data input/output terminal of the controller 26. The terminals TA5 and TB5 are also electrically connected to the ground terminal of the power supply unit 25A. That is, the terminals TA5 and TB5 are grounded.

As is apparent from the above description, the connectors 216A and 216B correspond to the mounting portions 24A and 24B. That is, the plurality of terminals TA3 and TB3 are terminals corresponding to the plurality of mounting portions 24, and are an example of a "signal output portion" in the present disclosure. The terminals TA5 and TB5 are examples of a "second detection terminal" in the present disclosure.

As illustrated in FIG. 4, each pump assembly 23 further includes a power supply unit 235, a drive unit 236, a motor 237, a controller 238, and a power supply path 239. The controller 238 is an example of a "controller" or a "second controller" in the present disclosure.

In each pump assembly 23, the connector 234 has at least terminals T1 to T5. When the connector 234 and the connector 216A are electrically connected (that is, in the mounted state), the terminals T1 to T5 are in contact with the terminals TA1 to TA5, respectively. The terminal T5 is an example of a "first detection terminal" in the present disclosure. Herein, the connectors 234 and 216A are designed to satisfy the following conditions 1 and 2. The condition 1 is that the timing at which the terminals T1 and TA1 come into contact with each other in the process of mounting the pump assemblies 23 on the mounting portion 24A substantially coincides with the timing at which the terminals T2 and TA2 come into contact with each other. The condition 2 is that, since the terminal TA5 is formed in a shape different from that of the terminal TA1, the timing at which the terminals T5 and TA5 come into contact with each other in the mounting process of the pump assembly 23 is delayed by a predetermined time from the timing at which the terminals T2 and TA2 come into contact with each other.

When the connector 234 is electrically connected to the connector 216B, the terminals T1 to T5 are in contact with the terminals TB1 to TB5, respectively, similarly to the terminals TA1 to TA5.

The power supply unit 235 is, for example, a battery, and outputs a DC voltage Vdd2. The value of the DC voltage Vdd2 is not particularly limited, but is substantially the same as, for example, the DC voltage Vdd1. Note that the power supply unit 235 may be a power supply circuit instead of the button battery. In the case of the power supply circuit, the power supply unit 235 generates the DC voltage Vdd2 from the DC voltage Vcc supplied from the power supply unit 25A through the terminals T1 and T2.

The drive unit 236 is, for example, an H-bridge circuit. A drive voltage based on the DC voltage Vcc is applied to the drive unit 236. In the H-bridge circuit, the four switching elements are turned on and off under the control by the controller 238. As a result, the drive unit 236 controls the direction of the current flowing through the motor 237 and the rotation speed of the motor 237.

The motor 237 has a rotatable output shaft. The pump rotor 233 is mechanically connected to the output shaft. The motor 237 rotates under the control of the drive unit 236 to generate power. As in a well-known technique, the motor 237 detects the rotation speed of the output shaft, and outputs a signal indicating the rotation speed which has been detected (hereinafter, referred to as "detected rotation speed") to the controller 238. The motor 237 is an example of a "motor" in the present disclosure.

The pump rotor 233 rotates by power generated by the motor 237.

The controller 238 has a microcomputer, a memory, and the like that are not shown. The microcomputer operates by the DC voltage Vdd2 supplied from the power supply unit 235. The microcomputer operates according to a program stored in the memory.

Specifically, the controller 238 has an input terminal of the detected rotation speed input from the motor 237. The controller 238 has an input terminal for a pulse width modulation (PWM) signal output from the controller 26. The controller 238 turns on and off each switching element included in the H-bridge circuit based on the input detected rotation speed and the PWM signal.

The controller 238 has an input terminal of a hot plug signal (hereinafter, referred to as an "HP signal"). The input terminal is electrically connected to the terminal T5. In addition, the DC voltage Vdd2 from the power supply unit 235 is supplied to the terminal T5 via a resistor R1. Therefore, when the terminal T5 is not in contact with one of the terminals TA5 and TB5 (that is, in the non-mounted state), the DC voltage Vdd2 is input to the controller 238 as the HP signal. In the non-mounted state, the HP signal is at a high level (DC voltage Vdd2). On the other hand, when the terminal T5 is in contact with one of the terminals TA5 and TB5 (that is, in the mounted state), the terminal T5 is connected to the ground terminal of the power supply unit 25A. Therefore, in the mounted state, the HP signal is at a low level (0 V).

The controller 238 has an input terminal for a position signal. The input terminal is electrically connected to the terminal T3. Therefore, when the terminal T3 is in contact with the terminal TA3 of the connector 216A, the DC voltage Vdd1 is input to the controller 238 as a high-level position signal. On the other hand, when the terminal T3 is in contact with the terminal TB3 of the connector 216B, 0 V is input to the controller 238 as a low-level position signal. Therefore, each pump assembly 23 has the terminal T3 to which a position signal is input from a corresponding one of the terminals TA3 and TB3 when mounted to any of the plurality of mounting portions 24. The terminals T3 and T3 are examples of a "signal input portion" or a "first detection terminal" in the present disclosure.

Further details of the HP signal and the position signal will be described later.

The controller 238 has a data input/output terminal. The input/output terminal is electrically connected to the terminal T4. Therefore, in a case where the terminal T4 is in contact with the terminal TA4 or the terminal TB4, the controller 238 can perform data communication with the controller 26.

The power supply path 239 electrically connects the motor 237 and the connector 234. Specifically, the power supply path 239 has two power lines, and electrically connects the terminals T1 and T2 and the drive unit 236. The power supply path 239 is provided with a load switch, an inrush current protection circuit, and a drive circuit for the load switch. A well-known technique can be applied to the load switch, the inrush current protection circuit, and the drive circuit of the load switch, which are not main portions of the example embodiment, and thus illustration and description thereof will be omitted.

Figure 5:
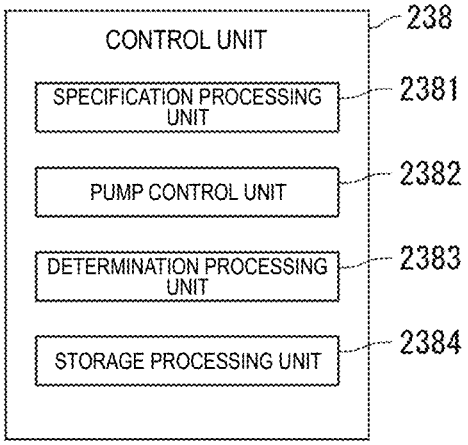
FIG. 5 is a functional block diagram of a controller of the pump assembly.

FIG. 5 is a functional block diagram of the controller 238. As illustrated in FIG. 5, the controller 238 functions as a specification processing unit 2381, a pump controller 2382, a determination processing unit 2383, and a storage processing unit 2384 by executing a program.

When functioning as the specification processing unit 2381, the controller 238 executes specification processing of specifying the mounted state of the pump assembly 23 to any one of the plurality of mounting portions 24 a plurality of times at time intervals. When functioning as the pump controller 2382, the controller 26 executes control of the pump assembly 23 mounted to the plurality of mounting portions 24 (in the example embodiment, any one of the mounting portions 24A and 24B) based on the mounted state specified in the specification processing. As a result, the pump assembly 23 operates under the control of the controller 238 and pressure-feeds the refrigerant to the flow path 27. As a result, it is possible to provide the refrigerant circulation device 2 capable of accurately recognizing to which mounting portion 24 the pump assembly 23 is mounted among the plurality of mounting portions 24. In particular, in the specification processing, since the mounted state of the pump assembly 23 is specified a plurality of times, continuation of the control of the pump assembly 23 based on the incorrect mounted state is suppressed.

Preferably, in a case where the controller 238 functions as the determination processing unit 2383, the controller further executes determination processing of determining that the pump assembly 23 is mounted to any of the plurality of mounting portions 24. The controller 238 starts the specification processing in response to the determination processing that the pump assembly 23 is mounted. Accordingly, the specification processing is executed at an appropriate timing. That is, the specification processing is not executed at unnecessary timing.

Preferably, when functioning as the determination processing unit 2383, the controller 238 executes the determination processing based on the voltage appearing at the terminal T5. It is possible to easily determine that the pump assembly 23 is mounted to the mounting portion 24.

Preferably, the controller 238 periodically specifies the mounted state of the pump assembly 23 in the specification processing. Accordingly, the specification processing can be easily performed.

Preferably, when functioning as the storage processing unit 2384, the controller 238 further executes storage processing of storing each of the mounted states specified in the specification processing. When functioning as the pump controller 2382, the controller 238 executes control of the pump assemblies 23 mounted to the plurality of mounting portions 24 based on the latest mounted state in the storage processing. This suppresses continuation of the control of the pump assembly based on the incorrect mounted state.

Preferably, when functioning as the specification processing unit 2381 and the pump controller 2382, the controller 238 executes the specification processing and the control of the pump assembly 23 based on the position signal input to the terminal T3. When the refrigerant circulation device 2 includes the plurality of pump assemblies 23, the internal configuration of each pump assembly 23 is made common.

Furthermore, when functioning as the specification processing unit 2381, the controller 238 executes the specification processing based on the position signal input to the terminal T3. Furthermore, when functioning as the pump controller 2382, the controllers 26 and 238 may execute control of each pump assembly 23 based on each mounted state specified in the specification processing. When the refrigerant circulation device 2 includes the plurality of pump assemblies 23, the internal configuration of each pump assembly 23 is made common.

Figure 6:
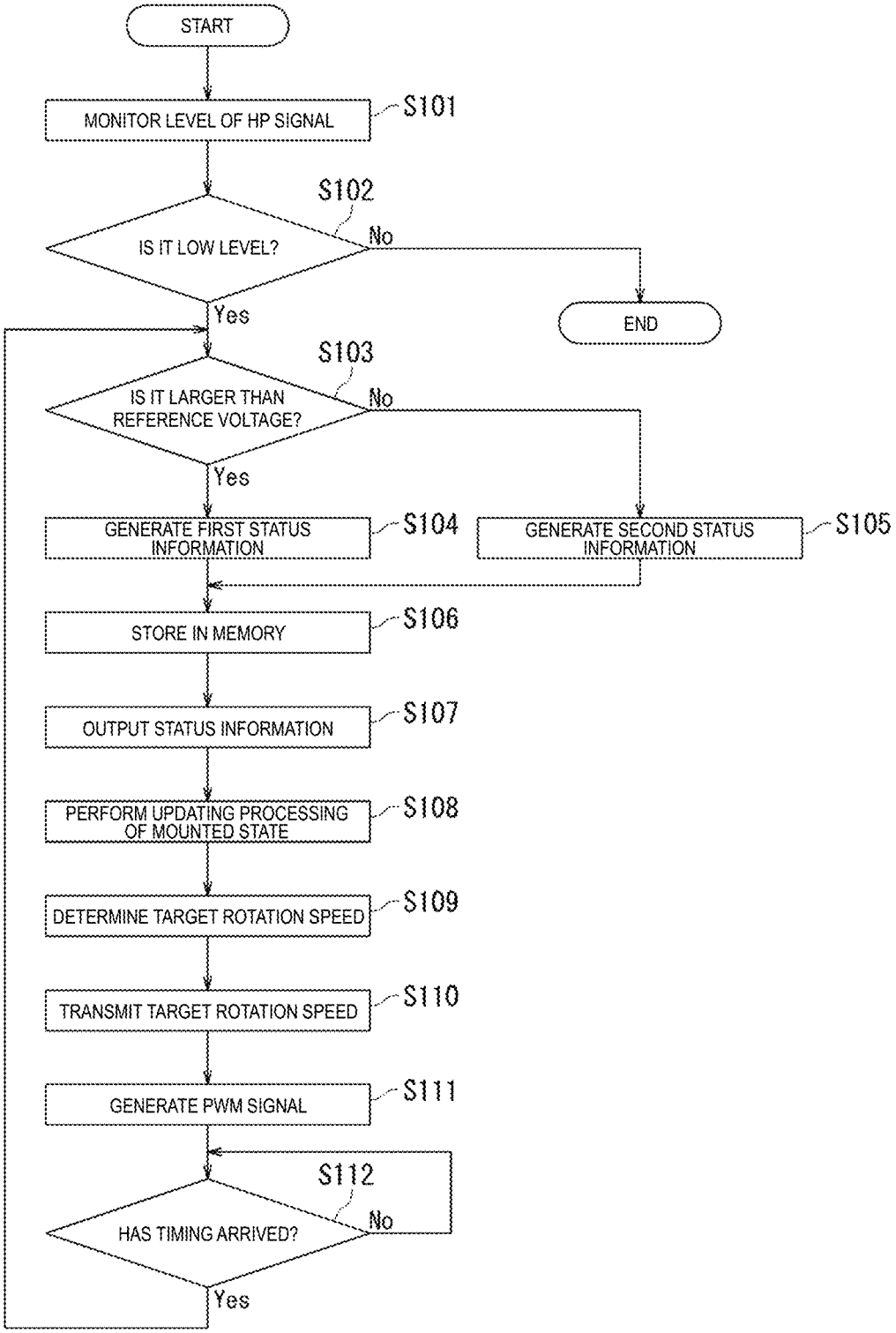
FIG. 6 is a flowchart illustrating an operation when the pump assembly is mounted to the mounting portion in the refrigerant circulation device.

FIG. 6 is a flowchart illustrating an operation when the pump assembly 23 is mounted to the mounting portion 24 in the refrigerant circulation device 2. The flowchart of FIG. 6 includes steps S101 to S112.

The controller 238 periodically functions as the determination processing unit 2383 (see FIG. 5) in steps S101 and S102 of FIG. 6 while the pump assembly 23 is supplied with the DC voltage Vdd2 even in the non-mounted state.

Specifically, in step S101, the controller 238 periodically monitors the level of the HP signal input to the terminal T5. That is, step S101 is periodically performed.

In step S102, the controller 238 determines whether the level of the HP signal is a low level. When it is determined that the current level is not the low level (No in step S102), the process of FIG. 6 ends, and the controller 238 waits for the execution timing of the next step S101. On the other hand, when it is determined that the current level is the low level (Yes in step S102), it is determined that the connector 234 is connected to the connector 216A or the connector 216B, and the process proceeds to step S103.

In steps S103 to S105, the controller 238 functions as the specification processing unit 2381 (see FIG. 5). Specifically, in step S103, the controller 238 determines whether the level of the position signal input to the terminal T3 is higher than the reference voltage. The reference voltage is, for example, a voltage lower than the DC voltage Vdd1 and higher than 0 V. When it is determined that the voltage is higher than the reference voltage (Yes in step S103), the process proceeds to step S104. On the other hand, when it is determined that the voltage is equal to or lower than the reference voltage (No in step S103), the process proceeds to step S105.

In both steps S104 and S105, the controller 238 specifies the mounted state of the pump assembly 23. In particular, when the process proceeds to step S104, the controller 238 determines that the pump assembly 23 is currently mounted to the mounting portion 24A, and generates status information (hereinafter, described as "first status information") indicating the mounted state. On the other hand, when the process proceeds to step S105, the controller 238 determines that the pump assembly 23 is currently mounted to the mounting portion 24B, and generates status information (hereinafter, described as "second status information") indicating the mounted state.

When one of steps S104 and S105 ends, the controller 238 functions as the storage processing unit 2384 (see FIG. 5) in step S106. Specifically, in step S106, the controller 238 stores, in a memory (not illustrated) of the controller 238, the first status information or the second status information generated in any of the previous steps S104 and S105. When the first status information or the second status information is already stored in the memory, in step S106, the controller 238 updates the existing first status information or second status information with one of the new first status information and the new second status information.

Next, in step S107, the controller 238 outputs the latest first status information or second status information stored in the memory from the data input/output terminal toward the terminal T4. As a result, the controller 26 receives the first status information or the second status information from the controller 238 from either the terminal TA4 or the terminal TB4.

Next, in step S108, the controller 26 executes a mounted state updating process. Specifically, the controller 26 includes a memory (not illustrated). Storage areas A and B for the mounting portions 24A and 24B are secured in the memory. In step S108, the controller 26 stores the status information received from the terminal TA4 in the storage area A, and stores the status information received from the terminal TB4 in the storage area B. As a result, the status information indicating the current mounted state of the pump assembly 23 with respect to each of the mounting portions 24A and 24B is stored in the memory.

In steps S109 to S111, the controllers 26 and 238 function as the pump controller 2382. Specifically, in step S109, the controller 26 determines the target rotation speed of each pump assembly 23 currently mounted to the chassis 21 based on the status information in each storage area. Specifically, when the pump assembly 23 is mounted only to the mounting portion 24A, the target rotation speed (hereinafter, described as "first target rotation speed") of the motor 237 of the pump assembly 23 is determined. When the pump assembly 23 is mounted only to the mounting portion 24B, a target rotation speed (hereinafter, it is referred to as a "second target rotation speed") of the motor 237 included in the pump assembly 23 is determined. When the pump assembly 23 is mounted to both the mounting portions 24A and 24B, the target rotation speed (hereinafter, "third target rotation speed" and "fourth target rotation speed" are described) of each pump assembly 23 is determined. The third target rotation speed and the fourth target rotation speed may indicate the same rotation speed. However, so-called pipe resistances to the suction ports 231 of the pump assemblies 23 of the mounting portions 24A and 24B are usually different. Therefore, the third target rotation speed and the fourth target rotation speed may be determined based on the difference in pipe resistance.

In step S110, the controller 26 outputs the determined target rotation speed from its own data input/output terminal toward the terminal TA4 and/or the terminal TB4 in order to transmit the determined target rotation speed to the pump assembly 23 of the corresponding mounting portions 24A and 24B.

Next, in step S111, the target rotation speed is input to the pump assembly 23 of the mounting portion 24A and/or the mounting portion 24B. In each pump assembly 23, the controller 238 receives the target rotation speed from the terminal T4, generates a PWM signal according to the received target rotation speed and the detected rotation speed from the motor 237, and outputs the PWM signal to the drive unit 236. As a result, the drive unit 236 controls the direction of the current flowing through the motor 237 and the rotation speed of the motor 237 with the drive voltage obtained by turning on and off the DC voltage Vcc by the PWM signal.

After completion of step S111, in step S112, the controller 238 determines whether the timing to execute step S103 has come. Preferably, the program is designed so that step S103 is periodically executed. In a case where it is determined that the timing has not arrived (No in step S112), the process returns to step S112. On the other hand, when it is determined that the timing has arrived (Yes in step S112), the process returns to step S103.

Figure 7:
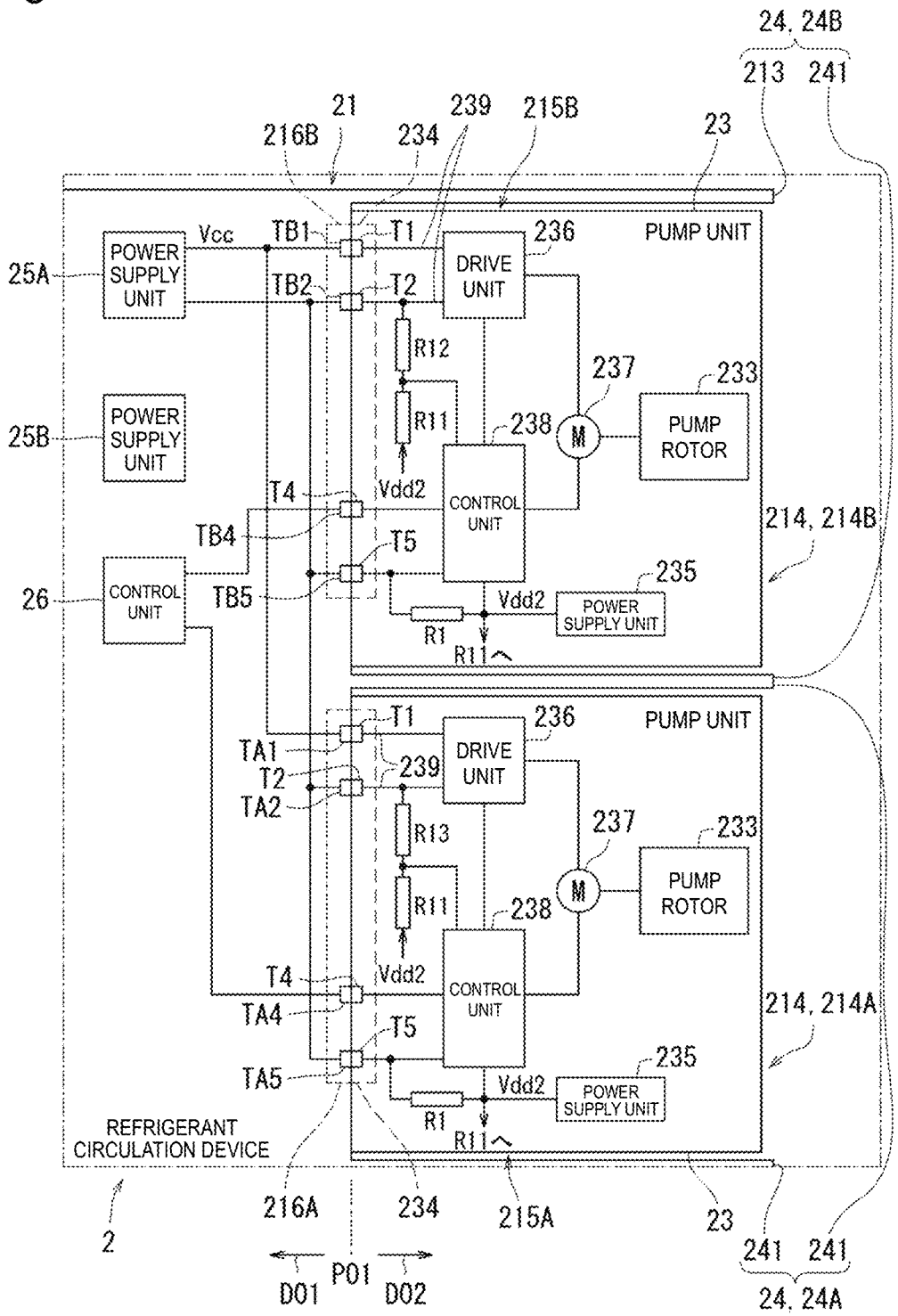
FIG. 7 is a block diagram illustrating a main portion of a cooling system according to a modification of an example embodiment of the present disclosure.

FIG. 7 is a block diagram illustrating a main portion of a refrigerant circulation device 2 according to a modification. As illustrated in FIG. 7, the refrigerant circulation device 2 according to the modification is different from the refrigerant circulation device 2 according to the example embodiment in the following points. First, the pump assemblies 23 do not have the same specification, but have different specifications as described below. The connectors 216A and 216B do not have terminals TA3 and TB3, respectively. Each connector 234 does not have the terminal T3.

To one of the two pump assemblies 23, the terminal T2 is supplied with the DC voltage Vdd2 from the power supply unit 235 via the resistors R11 and R12. Therefore, in the non-mounted state, a first voltage level is input as the position signal to the input terminal of the position signal in the controller 238. On the other hand, in the mounted state, the terminal T2 is connected to the ground terminal of the power supply unit 25A. Therefore, in the mounted state, a second voltage level different from the first voltage level is input as the position signal to the input terminal of the position signal in the controller 238.

To the other one of the two pump assemblies 23, the terminal T2 is supplied with the DC voltage Vdd2 from the power supply unit 235 via the resistors R11 and R13. The value of the resistor R13 is different from the value of the resistor R12. Therefore, in the non-mounted state, a first voltage level is input as the position signal to the input terminal of the position signal in the controller 238. On the other hand, in the mounted state, the terminal T2 is connected to the ground terminal of the power supply unit 25A. Therefore, in the mounted state, a third voltage level different from the first voltage level and the second voltage level is input as the position signal to the input terminal of the position signal in the controller 238.

Therefore, each pump assembly 23 according to the modification can also execute the same specification processing as in the example embodiment.

Note that, in the example embodiment or the modification, the number of each of the mounting portions 24 and the pump assemblies 23 is 2. However, the present disclosure is not limited thereto, and the number of each of the mounting portion 24 and the pump assembly 23 may be three or more. In this case, the voltage level of the position signal is appropriately set.

In the example embodiment or the modification, the controllers 26 and 238 cooperatively control the pump assembly 23. However, the present disclosure is not limited thereto, and the controller 26 and the controller 238 may individually execute the specification processing and the control of the pump assembly 23.

The drawings schematically mainly show each constituent element in order to facilitate understanding of the present disclosure, and the thickness, length, number, interval, and the like of each constituent element that are shown may be different from the actual ones for convenience of the drawings. The configuration of each constituent element illustrated in the above example embodiment is an example and is not particularly limited, and it goes without saying that various modifications can be made without substantially departing from the effects of the present disclosure.

The present technology can also adopt the following configurations.

(1) A refrigerant circulation device including: a chassis including a flow path of refrigerant; at least one pump assembly; a plurality of mounting portions that are provided at different positions in the chassis and to which the pump assembly is detachably mounted, respectively; and a controller; wherein the controller is configured or programmed to execute: specification processing to specify a mounted state of the pump assembly to any one of the plurality of mounting portions a plurality of times at time intervals; and control of the pump assembly mounted to the plurality of mounting portions based on a mounted state specified in the specification processing; and the pump assembly pressure-feeds the refrigerant to the flow path under control of the controller.

(2) The refrigerant circulation device according to (1), in which the controller is configured or programmed to: further execute determination processing to determine that the pump assembly is mounted to any one of the plurality of mounting portions; and start the specification processing in response to determination that the pump assembly is mounted in the determination processing.

(3) The refrigerant circulation device according to (2), in which the pump assembly further includes: a first connector; a motor; and a power supply path that electrically connects the first connector and the motor; the chassis includes a second connector to which the first connector is detachably mounted in each of the plurality of mounting portions; the second connector includes a second detection terminal to be grounded; the first connector includes a first detection terminal connected to the second detection terminal when connected to the second connector; and the controller is configured or programmed to execute the determination processing based on a voltage of the first detection terminal.

(4) The refrigerant circulation device according to any one of (1) to (3), in which the controller is configured or programmed to periodically specify a mounted state of the pump assembly in the specification processing.

(5) The refrigerant circulation device according to any one of (1) to (4), in which the controller is configured or programmed to: further execute storage processing of storing each of mounted states specified in the specification processing; and execute control of the pump assembly mounted to the plurality of mounting portions based on a latest mounted state in the storage processing.

(6) The refrigerant circulation device according to any one of (1) to (5), in which the chassis further includes a plurality of signal output portions corresponding to the plurality of mounting portions and outputting a plurality of different signals; and the pump assembly includes: a signal input portion to which the signal is input from a corresponding one of the plurality of signal output portions when the pump assembly is mounted to any one of the plurality of mounting portions; and the controller that is configured or programmed to execute the specification processing and control of the pump assembly based on the signal input to the signal input portion.

(7) The refrigerant circulation device according to any one of (1) to (6), in which the controller is configured or programmed to include: a first controller that is provided on a side of the chassis; and a second controller that is provided on a side of the pump assembly; the chassis further includes a plurality of signal output portions corresponding to the plurality of mounting portions and outputting a plurality of different signals; the pump assembly further includes a signal input portion to which the signal is input from a corresponding one of the plurality of signal output portions when the pump assembly is mounted to any one of the plurality of mounting portions; the second controller is configured or programmed to execute the specification processing based on the signal input to the signal input portion; and the first controller and the second controller are configured or programmed to control the pump assembly based on each of the mounted states specified in the specification processing.

(8) A pump assembly that is detachably mounted to mounting portions provided at different positions in a chassis having a flow path of refrigerant, the pump assembly including: a controller; wherein the controller is configured or programmed to execute: specification processing to specify a mounted state of the pump assembly to the mounting portion a plurality of times at time intervals; and control of the pump assembly mounted to the plurality of mounting portions based on each of the mounted states specified in the specification processing.

The technology according to the present disclosure is suitable for a refrigerant circulation device and has industrial applicability.

Features of the above-described example embodiments and the modifications thereof may be combined appropriately as long as no conflict arises.

While example embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A refrigerant circulation device comprising:

a chassis including a flow path of refrigerant;

at least one pump assembly;

a plurality of mounting portions that are provided at different positions in the chassis and to which the pump assembly is detachably mounted, respectively; and a controller; wherein the controller is configured or programmed to execute:

specification processing to specify a mounted state of the pump assembly to any one of the plurality of mounting portions a plurality of times at time intervals; and control of the pump assembly mounted to the plurality of mounting portions based on a mounted state specified in the specification processing; and the pump assembly pressure-feeds the refrigerant to the flow path under control of the controller.

2. The refrigerant circulation device according to claim 1, wherein the controller is configured or programmed to:

further execute determination processing to determine that the pump assembly is mounted to any one of the plurality of mounting portions; and start the specification processing in response to determination that the pump assembly is mounted in the determination processing.

3. The refrigerant circulation device according to claim 2, wherein the pump assembly further includes:

a first connector;

a motor; and a power supply path that electrically connects the first connector and the motor;

the chassis includes a second connector to which the first connector is detachably mounted in each of the plurality of mounting portions;

the second connector includes a second detection terminal to be grounded;

the first connector includes a first detection terminal connected to the second detection terminal when connected to the second connector; and the controller is configured or programmed to execute the determination processing based on a voltage of the first detection terminal.

4. The refrigerant circulation device according to claim 1, wherein the controller is configured or programmed to periodically specify a mounted state of the pump assembly in the specification processing.

5. The refrigerant circulation device according to claim 1, wherein the controller is configured or programmed to:

further execute storage processing of storing each of mounted states specified in the specification processing; and execute control of the pump assembly mounted to the plurality of mounting portions based on a latest mounted state in the storage processing.

6. The refrigerant circulation device according to claim 1, wherein the chassis further includes a plurality of signal output portions corresponding to the plurality of mounting portions and outputting a plurality of different signals; and the pump assembly includes:

a signal input portion to which the signal is input from a corresponding one of the plurality of signal output portions when the pump assembly is mounted to any one of the plurality of mounting portions; and the controller that is configured or programmed to execute the specification processing and control of the pump assembly based on the signal input to the signal input portion.

7. The refrigerant circulation device according to claim 1, wherein the controller is configured or programmed to include:

a first controller that is provided on a side of the chassis; and a second controller that is provided on a side of the pump assembly;

the chassis further includes a plurality of signal output portions corresponding to the plurality of mounting portions and outputting a plurality of different signals;

the pump assembly further includes a signal input portion to which the signal is input from a corresponding one of the plurality of signal output portions when the pump assembly is mounted to any one of the plurality of mounting portions;

the second controller is configured or programmed to execute the specification processing based on the signal input to the signal input portion; and the first controller and the second controller are configured or programmed to control the pump assembly based on each of the mounted states specified in the specification processing.

8. A pump assembly that is detachably mounted to mounting portions provided at different positions in a chassis including a flow path of refrigerant, the pump assembly comprising:

a controller; wherein the controller is configured or programmed to execute:

specification processing to specify a mounted state of the pump assembly to the mounting portion a plurality of times at time intervals; and control of the pump assembly mounted to the plurality of mounting portions based on each of the mounted states specified in the specification processing.

* * * * *